US008065956B2

(12) United States Patent
Büssert et al.

(10) Patent No.: US 8,065,956 B2
(45) Date of Patent: Nov. 29, 2011

(54) PRESS

(75) Inventors: Jürgen Büssert, Igensdorf (DE); Jürgen Decker, Erlangen (DE); Thomas Heimann, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 217 days.

(21) Appl. No.: 12/309,452

(22) PCT Filed: Jul. 5, 2007

(86) PCT No.: PCT/EP2007/056817

§ 371 (c)(1),
(2), (4) Date: Jan. 20, 2009

(87) PCT Pub. No.: WO2008/012188

PCT Pub. Date: Jan. 31, 2008

(65) Prior Publication Data

US 2009/0301322 A1 Dec. 10, 2009

(30) Foreign Application Priority Data

Jul. 24, 2006 (DE) ..... 10 2006 034 201

(51) Int. Cl.
*B30B 1/10* (2006.01)

(52) U.S. Cl. ..... 100/286; 100/50; 100/287; 100/918; 72/451

(58) Field of Classification Search ..... 100/46, 100/49, 50, 280, 281, 283, 286, 287, 918; 72/451
See application file for complete search history.

(56) References Cited

U.S. PATENT DOCUMENTS

| | | | | | |
|---|---|---|---|---|---|
| 3,611,497 | A | * | 10/1971 | Gidge et al. | 100/286 |
| 4,920,782 | A | * | 5/1990 | Hellwig | 72/451 |
| 4,944,221 | A | * | 7/1990 | Leinhaas | 100/286 |
| 5,287,728 | A | * | 2/1994 | Yoshida | 74/40 |
| 5,306,136 | A | * | 4/1994 | Oomori et al. | 425/593 |
| 5,746,122 | A | * | 5/1998 | Gietz et al. | 100/43 |
| 2004/0183337 | A1 | * | 9/2004 | Wang et al. | 296/187.12 |

FOREIGN PATENT DOCUMENTS

| | | | |
|---|---|---|---|
| DE | 41 09 796 | A1 | 10/1992 |
| DE | 100 59 635 | A1 | 6/2002 |
| DE | 10 2005 026 818 | A1 | 1/2006 |
| EP | 0 635 320 | A1 | 1/1995 |
| EP | 1 600 225 | A1 | 11/2005 |
| FR | 2 671 501 | A1 | 7/1992 |
| JP | 5318187 | A | 12/1993 |
| JP | 2001 239398 | A | 9/2001 |

OTHER PUBLICATIONS

"Auf das Tempo kommt es an"; Blech 7-05; pp. 30-32. Germany.

* cited by examiner

*Primary Examiner* — Jimmy T Nguyen

(57) ABSTRACT

A press with a cylinder for the movement of a pressure element is described. The cylinder is connected to a toggle lever, wherein the toggle lever is connected to a drive and wherein the drive moves the cylinder via the toggle lever.

8 Claims, 3 Drawing Sheets

PRESS

CROSS REFERENCE TO RELATED APPLICATIONS

This application is the U.S. National Stage of International Application No. PCT/EP2007/056817 filed Jul. 5, 2007 and claims the benefit thereof. The International Application claims the benefits of German application No. 10 2006 034 201.1 DE filed Jul. 24, 2006, both of the applications are incorporated by reference herein in their entirety.

FIELD OF INVENTION

The invention relates to a press.

BACKGROUND OF INVENTION

In commercially available presses, hydraulic or pneumatic systems are used to produce the required pressing force, said systems comprising cylinders which act on a pressure element such as a lifting plate to produce e.g. selective shaping of a metal sheet.

Presses are also known which have an electrically actuated die cushion, in particular an electrically actuated lifting plate. For electrically actuated die cushions, particularly electrically actuated lifting plates, the hydraulic system is replaced by spindles which are actuated by a servo drive. In this drive system, the pressing force must be detected by pressure sensors. Servo drives with reduction gearing or direct drives without gearing are used here. Such a press is known from the printed article "Auf das Tempo kommt es an", *Blech* 7-05, pages 30 to 32.

SUMMARY OF INVENTION

In the case of presses in which the lifting plate is electrically actuated, a high gear ratio is generally required in order to generate the necessary torque for driving a spindle which moves the lifting plate via cylinders. However, the high motor speed required to enable the lifting plate to move at a sufficient velocity causes a high degree of wear.

An object of the invention is to create a press having a simply designed electric drive system for a pressure element.

This object is achieved by a press, wherein said press has a cylinder for moving a pressure element, the cylinder being connected to a toggle lever, the toggle lever being connected to a drive, and the drive moving the cylinder via the toggle lever.

Advantageous embodiments of the invention will emerge from the dependent claims.

It is found to be advantageous if the press has at least two cylinders for moving the pressure element, wherein a first cylinder is connected to a first toggle lever, a second cylinder is connected to a second toggle lever, and the first and the second toggle lever are connected to a common drive, the drive moving the first cylinder via the first toggle lever and moving the second cylinder via the second toggle lever. A common drive with two cylinders is advantageously used, as the drive system can then be of particularly simple design.

It is also found to be advantageous if the pressure element is embodied as a lifting plate. Embodying the pressure element as a lifting plate constitutes a normal embodiment of the pressure element.

It is also found to be advantageous if the drive has a rotary electric motor, wherein the stator of the electric motor is connected to a bushing, the rotor of the electric motor is connected to a nut, and the first and the second toggle lever are shortened or lengthened by rotation of the rotor. This enables the drive system to be of particularly simple design.

It is also found to be advantageous if the drive has a rotary electric motor, wherein the stator of the electric motor is connected to a joint of the first toggle lever, the rotor of the electric motor is connected to a bushing via a spindle and the first and the second toggle lever are shortened or lengthened by rotation of the rotor. This enables the drive system to be of particularly simple design.

It is also found to be advantageous if the drive has a rotary electric motor, the rotor of the electric motor acting on a first rod via a gear wheel connected to the rotor such that the first and the second toggle lever are shortened or lengthened by rotation of the rotor, and the stator of the electric motor being connected to a second rod. This enables the drive system to be of particularly simple design.

It is found to be advantageous, moreover, if the drive has an electric linear motor, wherein the primary section of the linear motor is connected to the second toggle lever and the secondary section of the linear motor is connected to the first toggle lever, the first and the second toggle lever being shortened or lengthened by movement of the primary section and/or secondary section. This enables the drive system to be of particularly simple design.

It is additionally found to the advantageous if the force exerted on a cylinder is determined on the basis of the motor current, as this obviates the need for a pressure measurement.

It is also found to be advantageous if a rotary position sensor is used to measure the linear position of the pressure element, as this obviates the need to use expensive linear measurement systems.

It is also found to be advantageous if a pressure measuring device is disposed between toggle lever and cylinder. Using a pressure measuring device enables the contact pressure of the cylinder to be very accurately controlled.

BRIEF DESCRIPTION OF THE DRAWINGS

Four exemplary embodiments of the invention will now be explained in greater detail with reference to the accompanying drawings in which.

DETAILED DESCRIPTION OF INVENTION

Figure 1:
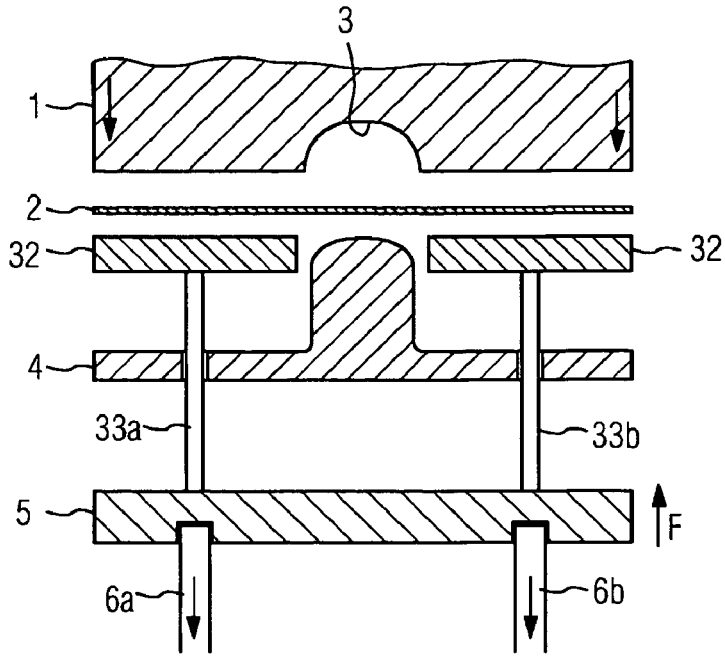
FIG. 1 schematically illustrates the pressure exerting components of a press, FIG. 2 schematically illustrates a first exemplary embodiment of the invention, FIG. 3 schematically illustrates a second exemplary embodiment of the invention, FIGS. 4,5 schematically illustrates a third exemplary embodiment of the invention and FIGS. 6,7 schematically illustrates a fourth exemplary embodiment of the invention.

FIG. 1 illustrates in schematic form the essential pressure exerting components of a press. For the pressing operation, a female die 1 is moved downward in a position controlled manner, as shown by the two arrows in FIG. 1. The female die 1 has a concavity 3 into which a male die 4 engages during the pressing operation, so that a sheet metal blank 2 acquires approximately the shape of the concavity 3 after the pressing operation. A counter-force F is applied by a pressure element 5 which in the context of the exemplary embodiments is embodied as a lifting plate 5. The lifting plate 5 transmits the counter-force F via two pressure columns 33*a* and 33*b* to a blank holder 32. While the female die 1 is moved downward in a position controlled manner during the pressing operation, the lifting plate 5 is forced downward in a pressure controlled manner. The movement of the lifting plate 5 is generally controlled by means of a plurality of cylinders which are forced downward in a pressure controlled manner during the pressing operation, as indicated by the corresponding arrows in FIG. 1, the moving process of the lifting plate 5 generally being controlled by means of a plurality of drives assigned to the cylinders.

In terms of the exemplary embodiments, the lifting plate 5 is moved by means of a first cylinder 6*a* and a second cylinder 6*b*. In commercially available machines, the drive system for the cylinders is based on a hydraulic or pneumatic system or on a spindle drive in which a server motor simultaneously drives a single cylinder or a plurality of cylinders via a spindle.

Toggle levers are used to produce the required counter-force F for the lifting plate. The combination of the known electric drive technology and the use of toggle levers allow electric drives that fulfill hydraulic engineering performance requirements to be used.

Figure 2:
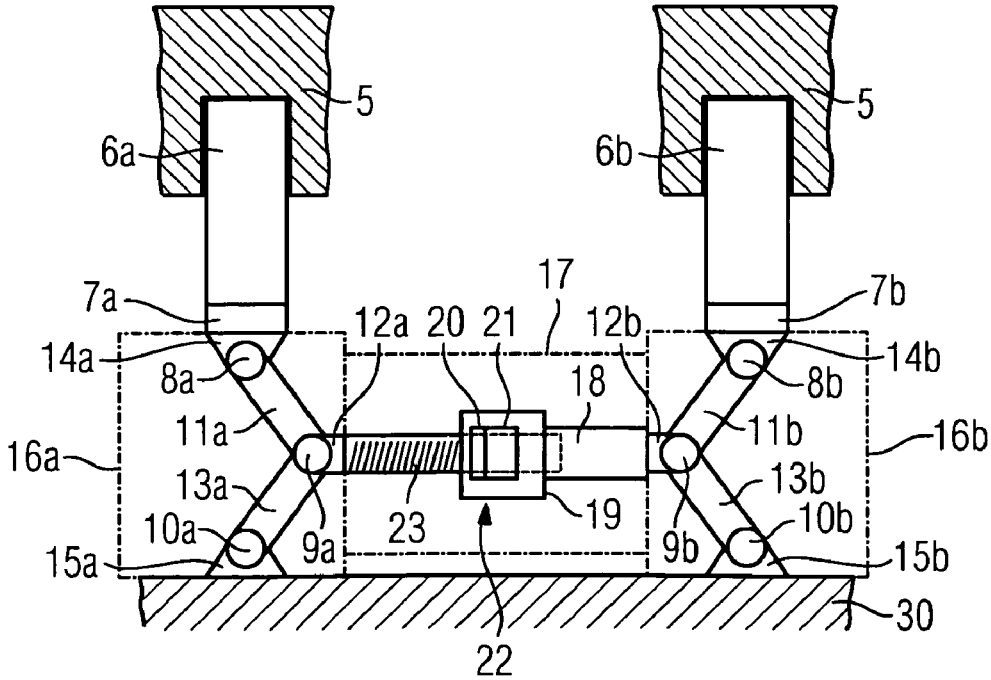

Through the use of toggle levers, the counter-force F which the lifting plate 5 can exert against the movement of the female die 1 can be multiplied compared to commercially available spindle drive systems FIG. 2 shows a first exemplary embodiment in the form of a schematic representation illustrating the drive system, consisting of a drive 17 and a first toggle lever 16*a* and a second toggle lever 16*b* for driving the first cylinder 6*a* and the second cylinder 6*b*. The first toggle lever 16*a* has two toggle lever rods 11*a* and 13*a* as well as three joints 8*a*, 9*a* and 10*a* and three flanging elements 14*a*, 15*a* and 12*a* which are interconnected in the manner shown in FIG. 2. The second toggle lever 16*b* correspondingly has the two toggle lever rods 11*b* and 13*b*, as well as the three joints 8*b*, 9*b* and 10*b* and the three flanging elements 12*b*, 14*b* and 15*b*. The flanging elements 14*a* and 14*b* are connected to the respectively assigned first cylinder 6*a* and second cylinder 6*b* by respectively assigned pressure sensors 7*a* and 7*b*. The flanging elements 15*a* and 15*b* are connected to the machine bed 30. The first toggle lever 16*a* and the second toggle lever 16*b* are connected to a common drive 17, said drive 17 moving the first cylinder 6*a* via the first toggle lever 16*a* and the second cylinder 6*b* via the second toggle lever 16*b*.

In terms of the first exemplary embodiment, the drive 17 has a spindle 23, a rotary electric motor 22 (e.g. a servo motor), and a bushing 18. The bushing 18 is connected to the second toggle lever 16*b* and the spindle 23 is connected to the first toggle lever 16*a*, the stator 19 of the electric motor 22 being fixedly connected to the bushing 18. The rotor 21 of the electric motor 22 is fixedly connected to a nut 20, the first toggle lever 16*a* and the second toggle lever 16*b* being shortened or lengthened by rotation of the rotor 21 by the spindles 23 being rotated into or out of the bushing 18 by rotation of the motor 19 by means of the rotor 21.

Figure 3:
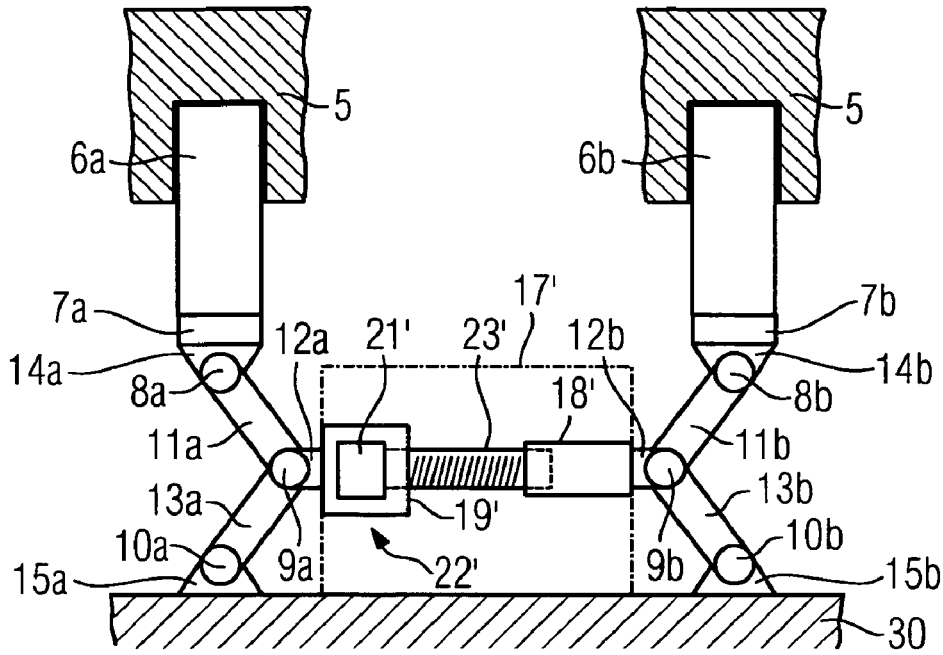

FIG. 3 illustrates another embodiment of the drive system in the form of a schematic drawing. As the embodiment shown in FIG. 3 essentially corresponds in terms of its basic design to the embodiment described above in FIG. 2, in FIG. 3 identical elements are provided with the same reference characters as in FIG. 2. The essential difference between the embodiment shown in FIG. 3 and the embodiment shown in FIG. 2 is in the embodiment of the drive 17' compared to the drive 17. In the embodiment according to FIG. 3, the drive 17' is likewise embodied as a rotary electric motor wherein, however, the stator 19' of the electric motor 22' is connected to a joint 9*a* of the first toggle lever 16*a* via a flanging element 12*a*, the rotor 21' of the electric motor 22' is connected to a bushing 18' via a spindle 23', and wherein the first and the second toggle lever (16*a*, 16*b*) are shortened or lengthened by rotation of the rotor 21'. By rotation of the rotor 21', depending on the direction of rotation, the spindle 23' is rotated either into or out of the bushing 18' which has a corresponding thread on its inner side.

Figure 4:
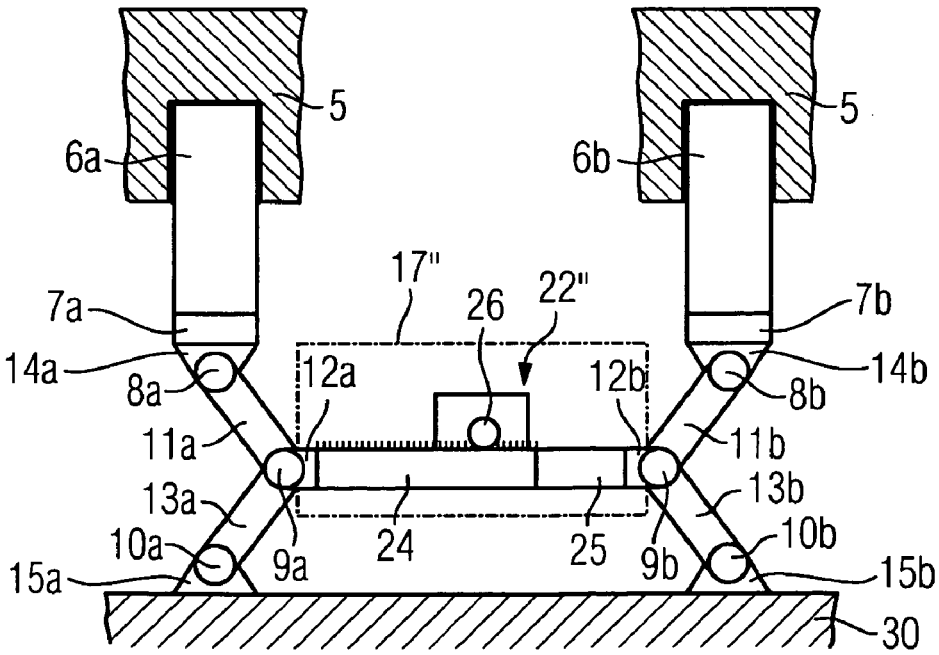
Figure 5:
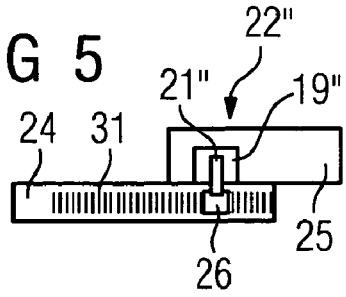

FIG. 4 and the associated FIG. 5 show another embodiment of the drive system. As the embodiment shown in FIG. 4 and FIG. 5 essentially corresponds in terms of its basic design to the embodiment described above with reference to FIG. 2, in FIG. 4 and FIG. 5 identical elements are therefore provided with the same reference characters as in FIG. 2. FIG. 5 shows a plan view onto the drive 17". The essential difference consists in the embodiment of the drive 17" compared to the drive 17 according to FIG. 2. The drive 17" as shown in FIG. 4 and FIG. 5 likewise has a rotary electric motor 22". A rotor 19" (see FIG. 5) acts on a first rod 24 via a gear wheel 26 connected to the rotor 19" such that, due to rotation of the rotor 21", the first and the second toggle lever 16*a* and 16*b* are shortened or lengthened, the stator 19" of the electric motor 22" being connected to a second rod 25, and the rod 25 being connected to a joint 9*b*. The first rod 24 is connected to teeth 31 which engage in the gear wheel 26. Due to the drive 17" being shortened or lengthened in the longitudinal direction by rotation of the rotor 21", the first and the second toggle lever are shortened or lengthened accordingly.

Figure 6:
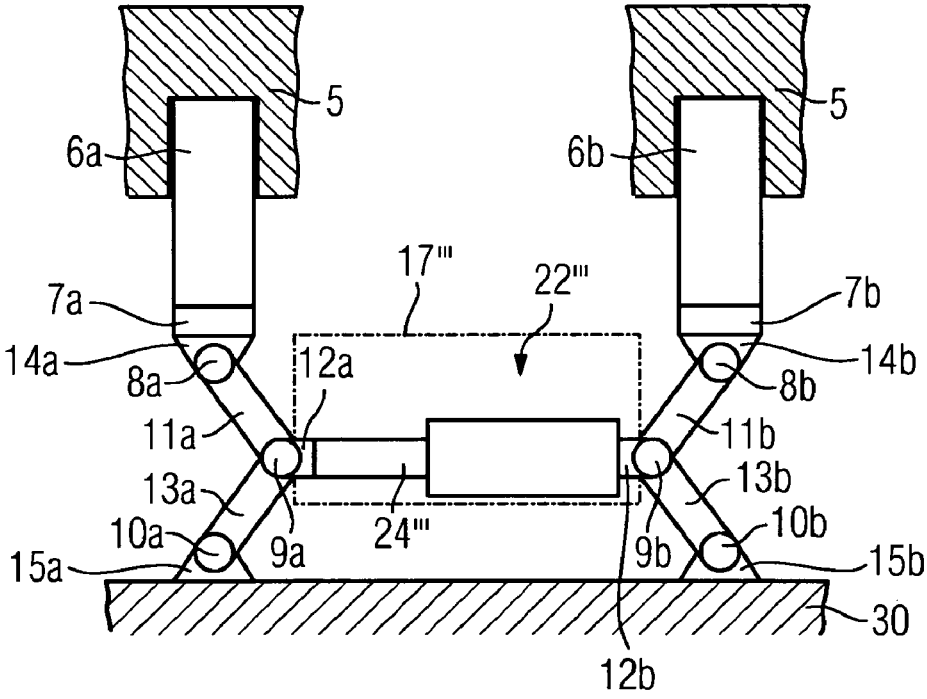
Figure 7:
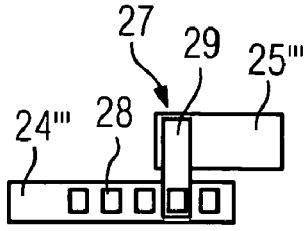

FIG. 6 and the associated FIG. 7 show another embodiment of the drive system. As the embodiment shown in FIG. 6 and FIG. 7 essentially corresponds in terms of its basic design to the embodiment described with reference to FIG. 2, in FIG. 6 and FIG. 7 identical elements are provided with the same reference characters as in FIG. 2. FIG. 7 shows a plan view onto the drive 17'''. The essential difference consists in the embodiment of the drive 17''' compared to the drive 17 as shown in FIG. 2. The drive 17''' has an electric linear motor 27. The primary section 29 (see FIG. 7) of the linear motor 27 is connected to the second toggle lever 16*b* and the secondary section 24''' having permanent magnets 28 is connected to the first toggle lever 16*a*. The first and the second toggle lever 16*a* and 16*b* are shortened or lengthened by movement of the primary section 29 and/or the secondary section 24'''. The primary section 29 is connected to a rod 25''', said rod 25''' being connected to the second toggle lever 16*b*. The drive 17''' is shortened or lengthened by displacement of the secondary section 24''' with respect of the primary section 29, causing the first and the second toggle lever 16*a* and 16*b* to be shortened or lengthened.

In the two embodiments according to FIG. 4, FIG. 5, FIG. 6 and FIG. 7 the use of a pressure measuring device (pressure sensor 7*a*, 7*b*) between toggle lever and cylinder can be dispensed with, as the force acting on the cylinder can be derived directly via measurement of the motor current.

In addition, when using rotary motors, the linear gauges otherwise used with hydraulic or pneumatic die cushions for position measurement can be dispensed with, as the position can be determined via a rotary position sensor preferably connected to the rotor of the motor.

Through the use of toggle levers, the counter-force can be multiplied, which means that the gear ratio of the rotary motors need not be selected so high, which in turn means that the motor speed can be selected lower. Low speeds have an advantageous effect on motor bearing life with the attendant advantage of lower wear.

It should be noted at this juncture that it is of course also possible for the cylinders to be actuated via a toggle lever using a single drive assigned to the respective cylinder.

The invention claimed is:

1. A press, comprising:

a pressure element;

at least two cylinders for moving the pressure element;

at least two toggle levers, the at least two cylinders being connected to the at least two toggle levers;

a common drive, the at least two toggle levers being connected to the common drive, wherein the drive moves the at least two cylinders via the at least two toggle levers;

wherein said at least two cylinders include a first cylinder being connected to a first toggle lever, a second cylinder being connected to a second toggle lever, wherein the common drive moves the first cylinder via the first toggle lever and moves the second cylinder via the second toggle lever, and wherein the common drive comprises a rotary electric motor with a stator and a Rotor, wherein the stator of the electric motor is connected to a bushing, the rotor of the electric motor is connected to a nut, and the first and the second toggle lever being shortened or lengthened by rotation of the rotor;

a female die with a concavity;

a male die configured to engage the concavity of the female die during operation of the press; and a sheet metal blank configured to acquire the shape of the concavity of the female die the element, wherein during the operation of the press, the female die is configured to be controllably moved downward and the pressure element is configured to be controllably forced downward.

2. The press as claimed in claim 1, wherein the pressure element is a lifting plate.

3. The press as claimed in claim 1, wherein a rotary position sensor is used to measure the linear position of the pressure element.

4. The press as claimed in claim 1, wherein a pressure measuring device is disposed between the first toggle lever and the first cylinder and between the second toggle lever and the second cylinder.

5. The press as claimed in claim 1, wherein said at least two toggle levers respectively comprise:

two toggle lever rods;

three joints; and three flanging elements;

wherein a first toggle lever rod is configured to be connected to the respective cylinder at a first end by a first joint and a first flanging element and is configured to be connected to the common drive at a second end opposite to the first end by a second joint and a second flanging element;

and wherein a second toggle lever rod is configured to be connected to the common drive at a first end by the second joint and the second flanging element and is configured to be connected to a machine bed by a third joint and a third flanging element.

6. The press as claimed in claim 5, wherein a respective pressure sensor is positioned at the first flanging element connecting the first and second toggle lever rod to the respective first and second cylinder.

7. The press as claimed in claim 1, wherein the common drive further comprises a spindle, and wherein the spindle is connected to the first toggle lever.

8. The press as claimed in claim 7, wherein the spindle is configured to rotate the rotor into or out of the bushing, and wherein the rotation of the rotor is configured to lengthen or shorten the first and second toggle lever.

* * * * *